US009293093B2

(12) United States Patent
Kim et al.

(10) Patent No.: US 9,293,093 B2
(45) Date of Patent: Mar. 22, 2016

(54) GATE DRIVER IN WHICH EACH STAGE THEREOF DRIVES MULTIPLE GATE LINES AND DISPLAY APPARATUS HAVING THE SAME

(71) Applicant: Samsung Display Co., LTD., Yongin, Gyeonggi-Do (KR)

(72) Inventors: Jong-Hee Kim, Hwaseong-si (KR); Yeong-Keun Kwon, Yongin-si (KR); Ji-Sun Kim, Seoul (KR); Jae-Keun Lim, Suwon-si (KR); Chong-Chul Chai, Seoul (KR)

(73) Assignee: Samsung Display Co., Ltd. (KR)

( * ) Notice: Subject to any disclaimer, the term of this patent is extended or adjusted under 35 U.S.C. 154(b) by 81 days.

(21) Appl. No.: 14/231,001

(22) Filed: Mar. 31, 2014

(65) Prior Publication Data

US 2015/0077407 A1 Mar. 19, 2015

(30) Foreign Application Priority Data

Sep. 17, 2013 (KR) ..... 10-2013-0111681

(51) Int. Cl.
*G09G 3/36* (2006.01)

(52) U.S. Cl.
CPC ..... *G09G 3/3611* (2013.01); *G09G 3/3677* (2013.01); *G09G 2300/0408* (2013.01); *G09G 2310/08* (2013.01)

(58) Field of Classification Search
CPC ..... G09G 2310/0286–2310/0297
USPC ..... 345/98–100
See application file for complete search history.

(56) References Cited

U.S. PATENT DOCUMENTS

| | | | | |
|---|---|---|---|---|
| 7,529,333 | B2 | 5/2009 | Kim et al. | |
| 7,548,228 | B2 | 6/2009 | Pak et al. | |
| 2007/0146289 | A1 * | 6/2007 | Lee et al. | 345/100 |
| 2008/0279327 | A1 * | 11/2008 | Liu et al. | 377/64 |
| 2011/0273407 | A1 | 11/2011 | Chung et al. | |
| 2011/0273417 | A1 * | 11/2011 | Shin et al. | 345/211 |
| 2012/0139883 | A1 | 6/2012 | Lee et al. | |
| 2012/0200544 | A1 | 8/2012 | Iwamoto et al. | |
| 2012/0239467 | A1 | 9/2012 | Winters et al. | |

FOREIGN PATENT DOCUMENTS

| | | |
|---|---|---|
| KR | 10-1159329 | 6/2012 |
| KR | 10-1244559 | 3/2013 |
| KR | 10-2013-0051340 | 5/2013 |

* cited by examiner

*Primary Examiner* — Long D Pham
(74) *Attorney, Agent, or Firm* — Innovation Counsel LLP

(57) ABSTRACT

A gate driver circuit includes an N-th stage ('N' is a natural number) The N-th stage ('N' is a natural number) includes a pull-up part configured to output an N-th gate signal using a first clock signal in response to a node signal of the control node, a carry part configured to output an N-th carry signal using the first clock signal in response to the node signal of the control node, an first output part connected to an n-th gate line and configured to output an n-th gate signal using the N-th gate signal in response to a second clock signal having a period shorter than the first clock signal ('n' is a natural number), and a second output part connected to an (n+1)-th gate line and configured to output an (n+1)-th gate signal using the N-th gate signal in response to an second inversion clock signal having a phase opposite to the second clock signal.

20 Claims, 7 Drawing Sheets

GATE DRIVER IN WHICH EACH STAGE THEREOF DRIVES MULTIPLE GATE LINES AND DISPLAY APPARATUS HAVING THE SAME

This application claims priority from and the benefit of Korean Patent Application No. 10-2013-0111681 filed on Sep. 17, 2013, which is hereby incorporated by reference for all purposes as if fully set forth herein.

BACKGROUND

1. Field of Disclosure

The present disclosure of invention relates to a gate driver circuit and a display apparatus having the gate driver circuit. More particularly, example embodiments in accordance with the present disclosure relate to a gate driver circuit configured so as to decrease circuit size and to a display apparatus having the above-mentioned gate driver circuit.

2. Description of Related Technology

Generally, a liquid crystal display (LCD) device includes an LCD panel that displays images using a light-transmitting ratio of liquid crystal molecules rotated relative to a polarizer, and a backlight assembly that is disposed below the LCD panel to provide the LCD panel with light.

The LCD device includes a display panel in which a plurality of pixels are connected to respective gate lines and to respective data lines crossing the gate lines which are formed on the panel. There are also provided a gate driver circuit configured for outputting gate signals to the gate lines and a data driver circuit configured for outputting data signals to the data lines. The gate driver circuit and the data driver circuit may each be formed in a chip type or monolithically integrally formed on a substrate of the display panel. Each pixel includes a pixel electrode and a thin film transistor (TFT). The thin film transistor of each respective pixel is connected to a corresponding data line, gate line and pixel electrode of its respective pixel and is connected to drive the pixel electrode. Generally, the thin film transistor includes an active semiconductive layer such as an amorphous silicon layer.

In order to decrease a total size of a gate driver circuit and to reduce the size of an LCD and to simplify the manufacture of the LCD, a process in which the gate driver circuit is monolithically integrated on the LCD panel has been developed. The integrated gate driver circuit consumes area on the substrate and includes thin film transistors which are formed via processes substantially the same as those used for forming the thin film transistors of the pixels. Accordingly, the thin film transistors of the gate driver circuit may include a similar active layer having for example amorphous silicon as its predominant constituent.

It is to be understood that this background of the technology section is intended to provide useful background for understanding the here disclosed technology and as such, the technology background section may include ideas, concepts or recognitions that were not part of what was known or appreciated by those skilled in the pertinent art prior to corresponding invention dates of subject matter disclosed herein.

BRIEF SUMMARY

Exemplary embodiments of the present disclosure of invention provide a gate driver circuit having a decreased circuit size.

Exemplary embodiments of the present disclosure provide a display apparatus having the gate driver circuit of reduced size and display panel with a narrower bezel.

According to an exemplary embodiment of the invention, there is provided a gate driver circuit including a shift register in which a plurality of stages is connected one after another to each other. An N-th stage ('N' is a natural number) includes a control pull-down part configured to apply a carry signal outputted from at least one of previous stages of the N-th stage to a control node, a pull-up part configured to output an N-th gate signal using a first clock signal in response to a node signal of the control node, a carry part configured to output an N-th carry signal using the first clock signal in response to the node signal of the control node, a first pull-down part configured to pull-down the node signal of the control node into a second OFF voltage in response to a carry signal outputted from at least one of next stages of the N-th stage next stage, a second pull-down part configured to pull-down the N-th gate signal into a first OFF voltage in response to a carry signal outputted from at least one of the next stages of the N-th stage, an first output part connected to an n-th gate line and configured to output an n-th gate signal using the N-th gate signal in response to a second clock signal having a period shorter than the first clock signal ('n' is a natural number), and a second output part connected to an (n+1)-th gate line and configured to output an (n+1)-th gate signal using the N-th gate signal in response to an second inversion clock signal having a phase opposite to the second clock signal.

In an exemplary embodiment, a high level of the second clock signal may be more than that of the first clock signal.

In an exemplary embodiment, the first pull-down part may include a plurality of transistor.

In an exemplary embodiment, the gate driver circuit may further include an inverting part configured to output an N-th inverting signal synchronized with the first clock signal during a remaining period of a frame period except for a period during which the N-th carry signal has a high level.

In an exemplary embodiment, the gate driver circuit may further include a first output holding part configured to maintain the n-th gate signal to the first OFF voltage in response to an inverting signal outputted from one of the previous stages and a second output holding part configured to maintain the (n+1)-th gate signal to the first OFF voltage in response to the N-th inverting signal.

In an exemplary embodiment, the first output holding part may be controlled by an (N−1)-th inverting signal outputted from an (N−1)-th stage.

In an exemplary embodiment, the gate driver circuit may further include a first holding part configured to maintain a signal of the control node to the second OFF voltage in response to the N-th inverting signal, a second holding part configured to maintain the N-th gate signal to the first OFF voltage in response to the N-th inverting signal and a third holding part configured to maintain the N-th carry signal to the second OFF voltage in response to the N-th inverting signal.

In an exemplary embodiment, the first holding part may include a plurality of transistors which is connected each other.

In an exemplary embodiment, the gate driver circuit may further include a fourth holding part configured to maintain the N-th gate signal to the first OFF voltage in response to the (N−1)-th inverting signal outputted from an (N−1)-th stage.

In an exemplary embodiment, the gate driver circuit may further include a first output holding part configured to maintain the N-th gate signal to a third OFF voltage in response to an inverting signal outputted from one of the previous stages and a second output holding part configured to maintain the (N+1)-th gate signal to the third OFF voltage in response to the N-th inverting signal.

In an exemplary embodiment, the third OFF voltage may have a level more than that of the first OFF voltage.

In an exemplary embodiment, the third OFF voltage may have a level less than that of the first OFF voltage.

According to an exemplary embodiment of the invention, there is provided a display apparatus. The display apparatus includes a display panel comprising a display area on which a plurality of gate lines, a plurality of data lines and a plurality of pixel transistors are formed and a peripheral area surrounding the display area, a data driver circuit outputting data signals to the data lines and a gate driver circuit comprising a shift register in which a plurality of stages is connected one after another to each other, each of the stages comprising a plurality of transistor. An N-th stage ('N' is a natural number) includes a control pull-down part configured to apply a carry signal outputted from at least one of previous stages of the N-th stage to a control node, a pull-up part configured to output an N-th gate signal using a first clock signal in response to a node signal of the control node, a carry part configured to output an N-th carry signal using the first clock signal in response to the node signal of the control node, a first pull-down part configured to pull-down the node signal of the control node into a second OFF voltage in response to a carry signal outputted from at least one of next stages of the N-th stage next stage, a second pull-down part configured to pull-down the N-th gate signal into a first OFF voltage in response to a carry signal outputted from at least one of the next stages of the N-th stage, an first output part connected to an n-th gate line and configured to output an n-th gate signal using the N-th gate signal in response to a second clock signal having a period shorter than the first clock signal ('n' is a natural number), and a second output part connected to an (n+1)-th gate line and configured to output an (n+1)-th gate signal using the N-th gate signal in response to an second inversion clock signal having a phase opposite to the second clock signal.

In an exemplary embodiment, a high level of the second clock signal may be more than that of the first clock signal.

In an exemplary embodiment, the N-th stage may further include an inverting part configured to output an N-th inverting signal synchronized with the first clock signal during a remaining period of a frame period except for a period during which the N-th carry signal has a high level.

In an exemplary embodiment, the N-th stage may further include a first output holding part configured to maintain the n-th gate signal to the first OFF voltage in response to an inverting signal outputted from one of the previous stages and a second output holding part configured to maintain the (n+1)-th gate signal to the first OFF voltage in response to the N-th inverting signal.

In an exemplary embodiment, the N-th stage may further include a first holding part configured to maintain a signal of the control node to the second OFF voltage in response to the N-th inverting signal, a second holding part configured to maintain the N-th gate signal to the first OFF voltage in response to the N-th inverting signal and a third holding part configured to maintain the N-th carry signal to the second OFF voltage in response to the N-th inverting signal.

In an exemplary embodiment, the N-th stage may further include a fourth holding part configured to maintain the N-th gate signal to the first OFF voltage in response to the (N−1)-th inverting signal outputted from an (N−1)-th stage.

In an exemplary embodiment, the N-th stage may further include a first output holding part configured to maintain the N-th gate signal to a third OFF voltage in response to an inverting signal outputted from one of the previous stages and a second output holding part configured to maintain the (N+1)-th gate signal to the third OFF voltage in response to the N-th inverting signal.

In an exemplary embodiment, the third OFF voltage may have a level different from that of the first OFF voltage.

According to the present disclosure of invention, a single stage outputs at least two respective gate signals to respectively drive at least two gate lines so that the number of transistors in the gate driver circuit may be decreased and a size of the gate driver circuit may be decreased. Thus, a size of the peripheral area in the display panel may be decreased so that the display apparatus may have a narrower bezel.

BRIEF DESCRIPTION OF THE DRAWINGS

The above and other features and advantages of the present disclosure of invention will become more apparent by describing in detailed exemplary embodiments thereof with reference to the accompanying drawings, in which.

DETAILED DESCRIPTION

Hereinafter, the present disclosure of invention will be explained in detail with reference to the accompanying drawings.

Figure 1:
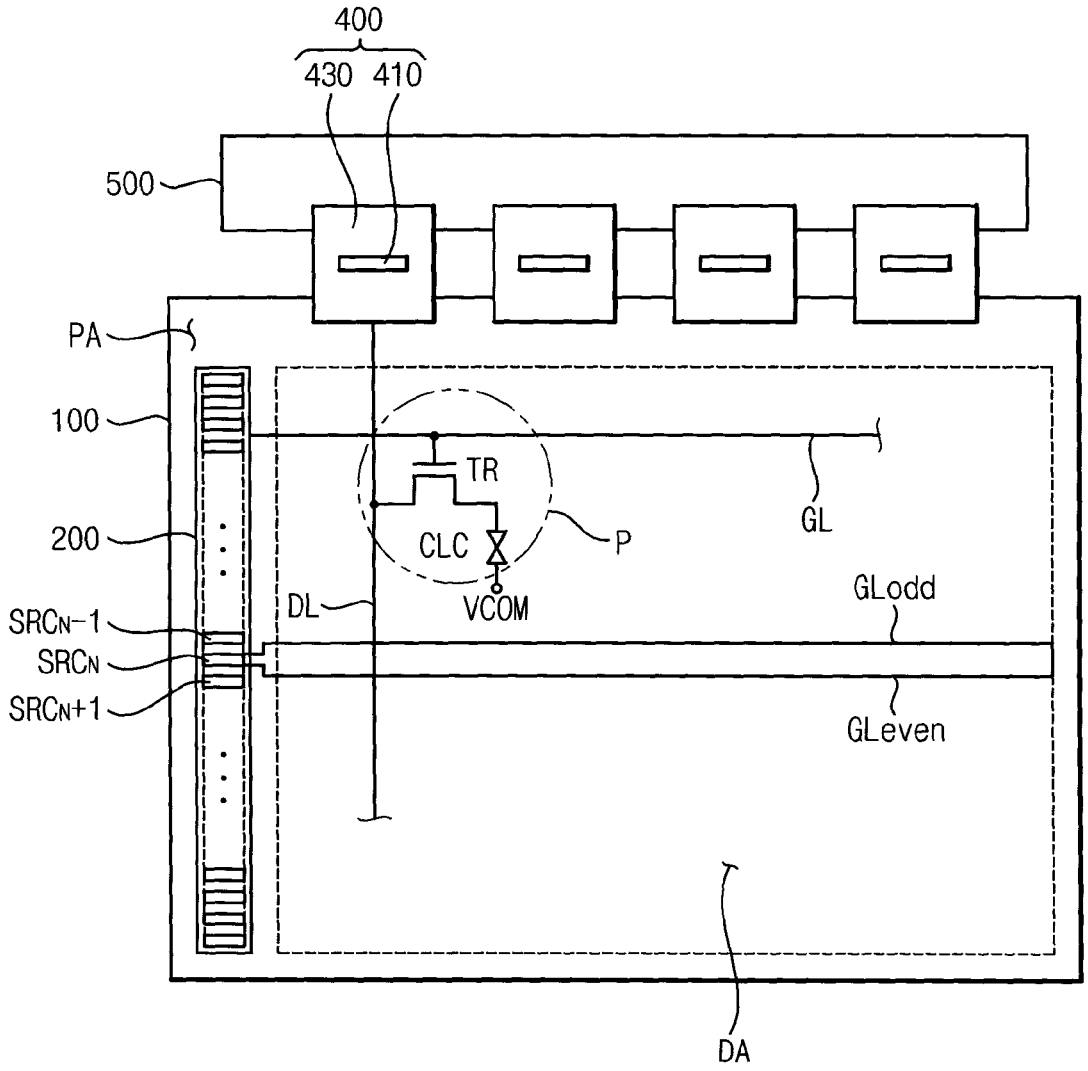
FIG. 1 is a plan view schematically showing a display apparatus according to an exemplary embodiment of the present disclosure of invention.

FIG. 1 is a plan view schematically showing a display apparatus according to a first exemplary embodiment in accordance with the present disclosure of invention.

Referring to FIG. 1, the display apparatus may include a display panel 100, a gate driver circuit 200 monolithically integrally formed on the panel 100, a data driver circuit 400 and a printed circuit board 500.

The display panel 100 includes an image providing display area DA and a non-displaying peripheral area PA surrounding the display area DA. A plurality of gate lines, a plurality of data lines and a plurality of pixel parts are disposed in the display area DA. Each of the pixel parts P include a pixel transistor TR which is electrically connected to a respective gate line GL and to a respective data line DL. Each pixel part P further includes a liquid crystal capacitor CLC which is electrically connected to the pixel transistor TR and a storage capacitor CST which is electrically connected to the liquid crystal capacitor CLC. The pixel transistor TR may include an active layer which has a semiconductive oxide. The semiconductive oxide may include an amorphous oxide having at least one of indium (In), zinc (Zn), gallium (Ga), tin (Sn) or hafnium (HF) as a predominant constituent. For example, the semiconductive oxide layer may include an amorphous oxide having as its predominant constituent, indium (In), zinc (Zn) and gallium (Ga) or an amorphous oxide having indium (In), zinc (Zn) and hafnium (HF). The semiconductive oxide may include an oxide such as indium zinc oxide (InZnO), indium gallium oxide (InGaO), indium tin oxide (InSnO), tin zinc oxide (ZnSnO), tin gallium oxide (GaSnO) and tin gallium oxide (GaZnO). Alternatively, the active layer of the pixel transistor TR may have a semiconductor such as amorphous silicon.

The gate driver circuit 200 includes a shift register that sequentially outputs gate signals with a temporary high level (row activating level) to the plurality in of gate lines GLs driven by the gate driver circuit 200. The shift register includes a plurality n of stages (e.g., SRCn-1, SRCn and SRCn+1, wherein 'n' is a natural number). The gate driver circuit 200 is monolithically integrated in the peripheral area PA adjacent to a first terminal end of the gate lines GL. The gate driver circuit 200 includes a plurality of circuit transistors, where the circuit transistors are formed via substantially the same processes as used for forming the transistors TR of the pixel parts P. In one embodiment, the circuit transistor has an active layer which has a semiconductive oxide. Alternatively, the active layer of the circuit transistor may have amorphous silicon. In alternative embodiments, the gate driver circuit 200 may be integrated on two spaced apart end portions of the gate lines GLs such to define a dual sided driver structure.

According to the present exemplary embodiment, each one stage of the gate driver circuit 200 generates a plurality of different gate signals and outputs the respective at least two gate signals to a corresponding at least two gate lines. For example, an N-th stage $SRC_N$ of FIG. 1 generates both an odd-numbered gate signal and an even-numbered gate signal and outputs both the odd-numbered and even-numbered gate signals to odd-numbered and even-numbered gate lines GLodd and GLeven, respectively. Thus, a size of the gate driver circuit 200 may be decreased because each stage drives plural gate lines rather than being dedicated on a one-to-one basis such that the full circuitry of each stage is dedicated to just one corresponding gate line.

The data driver circuit 400 of the exemplary embodiment includes one or more data drive chips 410 disposed on a corresponding one or more flexible printed circuit wiring substrates 430. That is, each data drive chip 410 may be mounted on a corresponding flexible circuit substrate 430. The flexible circuit substrate 430 electrically connects with the printed circuit board 500 and the display panel 100.

Figure 2:
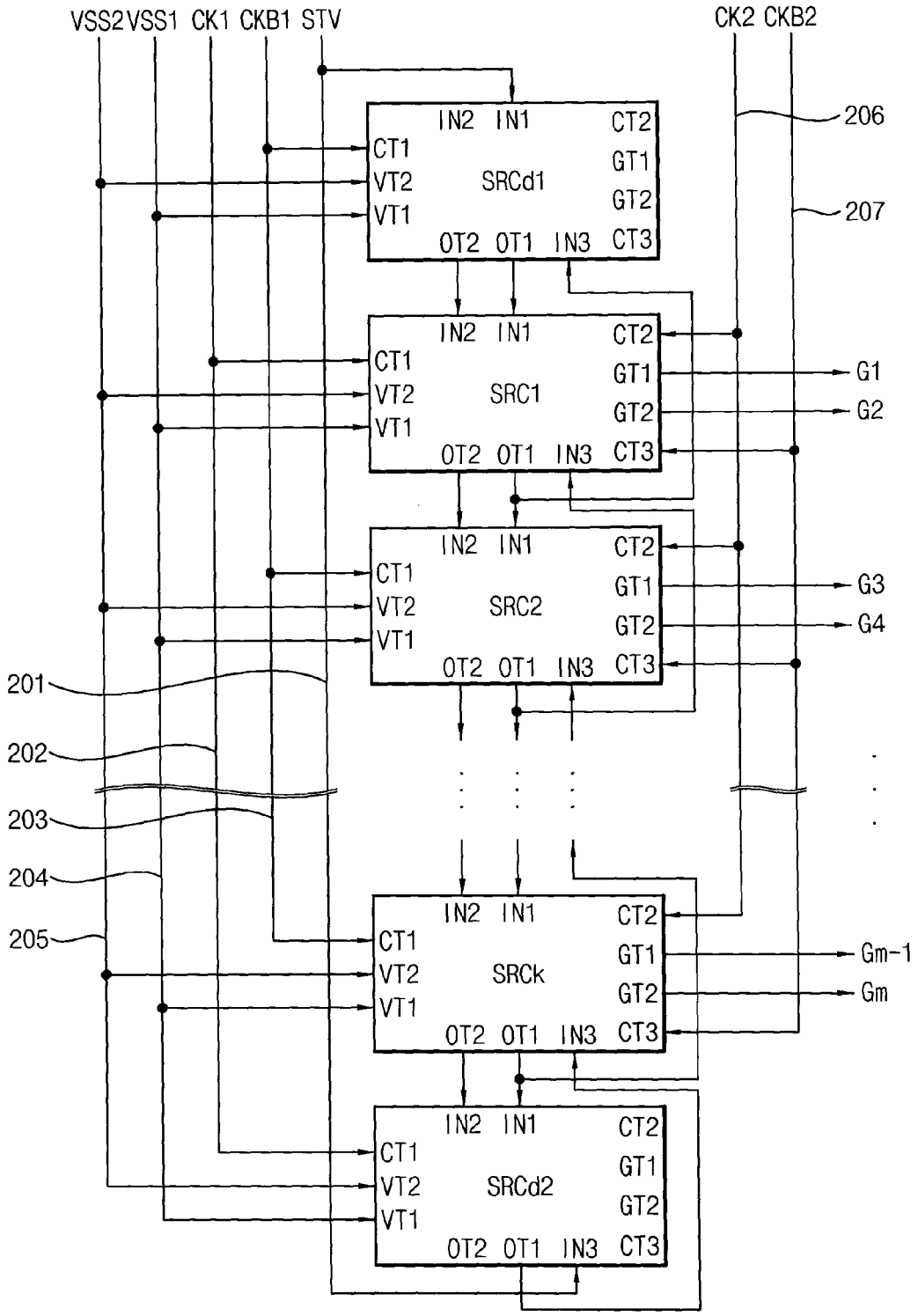
FIG. 2 is a block diagram illustrating a gate driver circuit of FIG. 1.

FIG. 2 is a block diagram illustrating a gate driver circuit in accordance with FIG. 1.

Referring to FIG. 2, the gate driver circuit 200 may include a plurality of vertically extending driving lines (vertical at least in the schematic) which transfer a plurality of driving signals to a vertically extending sequence of shift register stages, where the latter are each connected to the driving lines.

More specifically, the plurality of driving lines includes first, second, third, fourth, fifth, sixth and seventh driving lines 201, 201, 203, 204, 205, 206 and 207.

The first driving line 201 transfers a vertical start signal STV which signals to start a sequential operation within the gate driver circuit 200.

The second driving line 202 transfers a first clock signal CK1.

The third driving line 203 transfers a first inverted clock signal CKB1 having a phase opposite to that of the first clock signal CK1.

The fourth driving line 204 transfers a first OFF voltage VSS1. The first OFF voltage VSS1 has a first off level which is a low level of the to-be produced gate signals. For example, the first off level may be about −6 V relative to Vcom reference level.

The fifth driving line 205 transfers a second OFF voltage VSS2. The second OFF voltage VSS2 has a second off level which is even more negative (relative to Vcom) than that of the first off level VSS1. The second off level may be a low level of a control node Q in each stage. For example, the second off level may be about −10 V.

The sixth driving line 206 transfers a second clock signal CK2. The second clock signal CK2 may have a period shorter than that of the first clock signal CK1 and a high level higher than that of the first clock signal CK1. For example, the second clock signal CK2 may have ½ period of the first clock signal CK1.

The seventh driving line 207 transfers a second inverted clock signal CKB2 having a phase opposite to the second clock signal CK2.

The shift register includes first to k-th stages SRC1 to SRCk, plus a first dummy stage SRCd1 (shown on top) and a second dummy stage SRCd2 (shown at the bottom of FIG. 2) that are cascade-connected to each other. In this embodiment, 'k' is a natural number greater than one.

The first to k-th stages SRC1 to SRCk are respectively connected to first to m-th gate lines and sequentially output first to m-th gate signals G1 to Gm ('m' is a natural number that is at least two times k). The first dummy stage SRCd1 controls an operation of the first stage SRC1 and the second dummy stage SRCd2 controls an operation of the k-th stage SRCk. The first and second dummy stages SRCd1 and SRCd2 are not connected to operative gate lines.

According to the present exemplary embodiment, each of the first to k-th stages SRC1 to SRCk is connected to at least two corresponding gate lines and each sequentially outputs the respective gate signals of the at least two gate lines. For example, the N-th stage $SRC_N$ sequentially outputs the respective gate signal of and to an odd-numbered gate line and the respective gate signal of and to an even-numbered gate line.

According to the present exemplary embodiment, each stage of the shift register may include a first clock terminal CT1, a second clock terminal CT2, a third clock terminal CT3, a first input terminal IN1, a second input terminal IN2, a third input terminal IN3, a first voltage terminal VT1, a second voltage terminal VT2, a first output terminal OT1, a second output terminal OT2, a first gate output terminal GT1 and a second gate output terminal GT2. The first and second gate output terminals, GT1 and GT2, of non-dummy ones of the stages $SRC_J$ respectively connect to and drive corresponding, non-dummy gate lines G(2*J−1) and G(2*J).

The first clock terminal CT1 receives the first clock signal CK1 or the first inversion clock signal CKB1. The first clock terminals CT1 of the stages SRCd1, SRC1, . . . , SRCk, SRCd2 alternately receives the first clock signal CK1 and the first inversion clock signal CKB1 as shown.

For example, as shown in FIG. 2, the first clock terminals CT1 of the odd-numbered stages SRCd1, SRC2, SRC4, . . . , SRCk receive the first clock signal CK1 and the first clock terminals CT1 of the even-numbered stages SRC1, SRC3, . . . , SRCd2 receive the first inversion clock signal CKB1.

The second clock terminal CT2 receives the second clock signal CK2.

The third clock terminal CT3 receives the second inversion clock signal CKB2.

The first input terminal IN1 receives a vertical start signal STV or a carry signal outputted from at least one of previous stages in the sequence of stages. The first input terminal IN1 of the first dummy stage SRCd1 that is the first on top, receives the vertical start signal STV. Then, the first input terminals IN1 of the first to k stages SRC1 to SRCk and the second dummy stage SRCd2 respectively receive the carry signal outputted from at least one of previous stages in the sequence. For example, the first input terminal IN1 of the N-th stage of the first to k-th stages SRC1 to SRCk receives an (N−1)-th carry signal CRN-1 outputted from an (N−1)-th stage.

The second input terminal IN2 receives an inverting signal outputted from one of the previous stages of the self stage. The inverting signal is outputted from an inverting part in each stage and is synchronized with the first clock signal CK1 or the first inversion clock signal CKB1 received from the first clock terminal CT1 of each stage.

The third input terminal IN3 receives a carry signal outputted from at least one of next stages of the self stage or the vertical start signal STV. The third input terminals IN3 of the first dummy stage SRCd1 and the first stage to k-th stages SRC1 to SRCk respectively receive the carry signal outputted from at least one of next stages of the self stage. For example, the third input terminal IN3 of the N-th stage receive the carry signal outputted from an (N+1)-th carry signal CRN+1 of an (N+1)-th stage.

The first voltage terminal VT1 receives the first OFF voltage VSS1.

The second voltage terminal VT2 receives the second OFF voltage VSS2.

The first output terminal OT1 outputs the carry signal. The first output terminal OT1 is connected to the first input terminal IN1 of at least one of the previous stage, and is connected to the third input terminal IN3 of at least one of the next stages.

The second output terminal OT2 outputs the inverting signal. The second output terminal OT2 is connected to the second input terminal IN2 of at least one of the next stages.

The first gate output terminal GT1 is connected to an odd-numbered gate line of a pair gate lines adjacent to each other and outputs the gate signal to the odd-numbered gate line.

The second gate output terminal GT2 is connected to an even-numbered gate line of the pair gate lines adjacent to each other and outputs the gate signal to the even-numbered gate line. Therefore, as mentioned above, because each stage drives plural gate lines rather than being dedicated on a one-to-one basis such that the full circuitry of each stage is dedicated to just one corresponding gate line, a size of the gate driver circuit 200 may be decreased.

More specifically, and for example, referring to a J-th stage of the first to k-th stages SRC1 to SRCk, the first gate output terminal GT1 of that J-th stage is connected to a non-dummy G(2*J−1) gate line and outputs a corresponding (2*J−1)-th gate signal to that non-dummy G(2*J−1) gate line. At the same time, the second gate output terminal GT2 of that J-th stage is connected to a non-dummy G(2*J)-th gate line and outputs a corresponding (2*J)-th gate signal to that G(2*J)-th gate line. Yet more specifically, for the case of J=2 the GT1 terminal of $SRC_J$=$SRC_2$ drives the G(2*J−1)=G3 gate line and the GT2 terminal of $SRC_J$=$SRC_2$ drives the G(2*J)=G4 gate line as is shown in FIG. 2.

Figure 3:
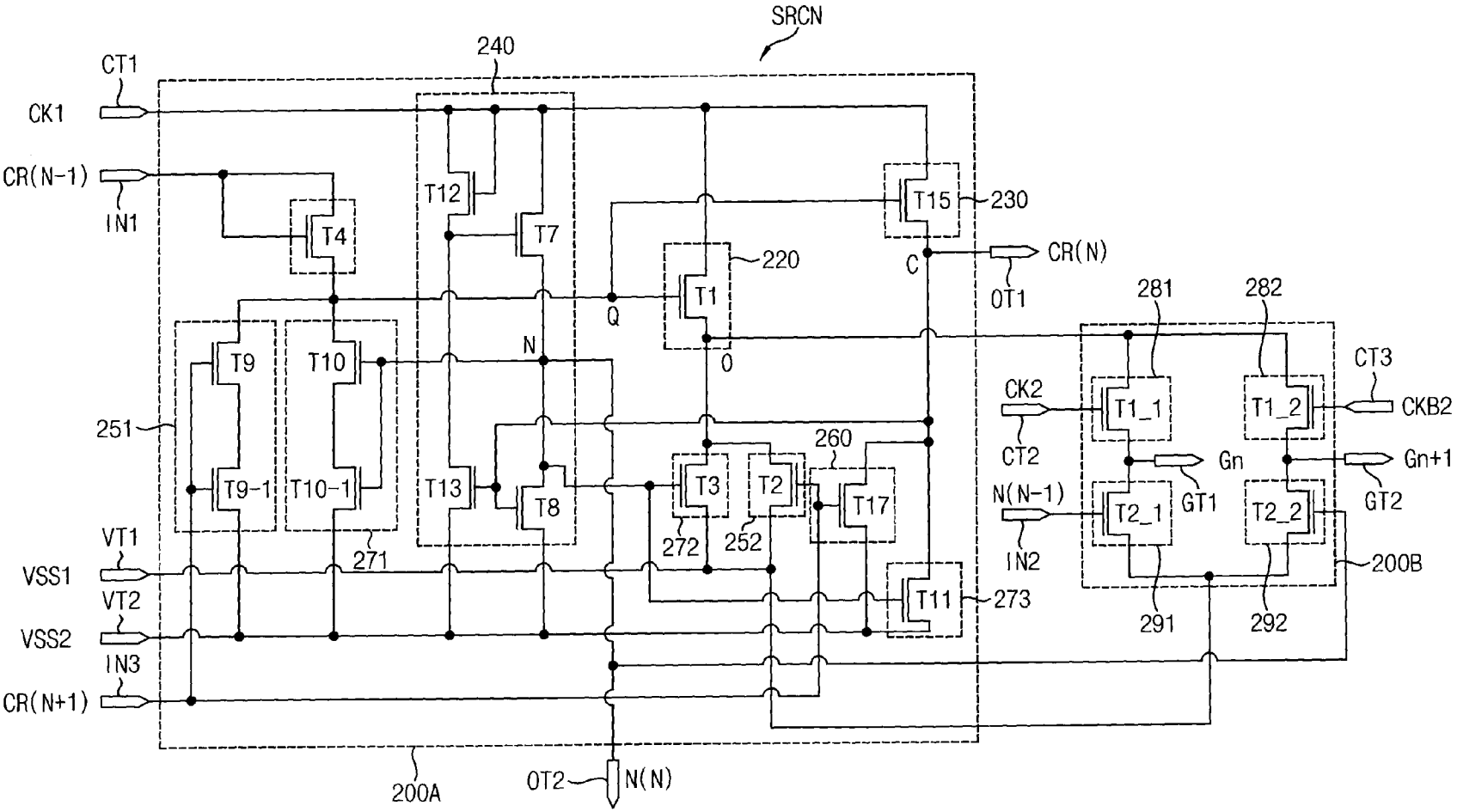
FIG. 3 is a circuit diagram illustrating a stage of FIG. 2.
Figure 4:
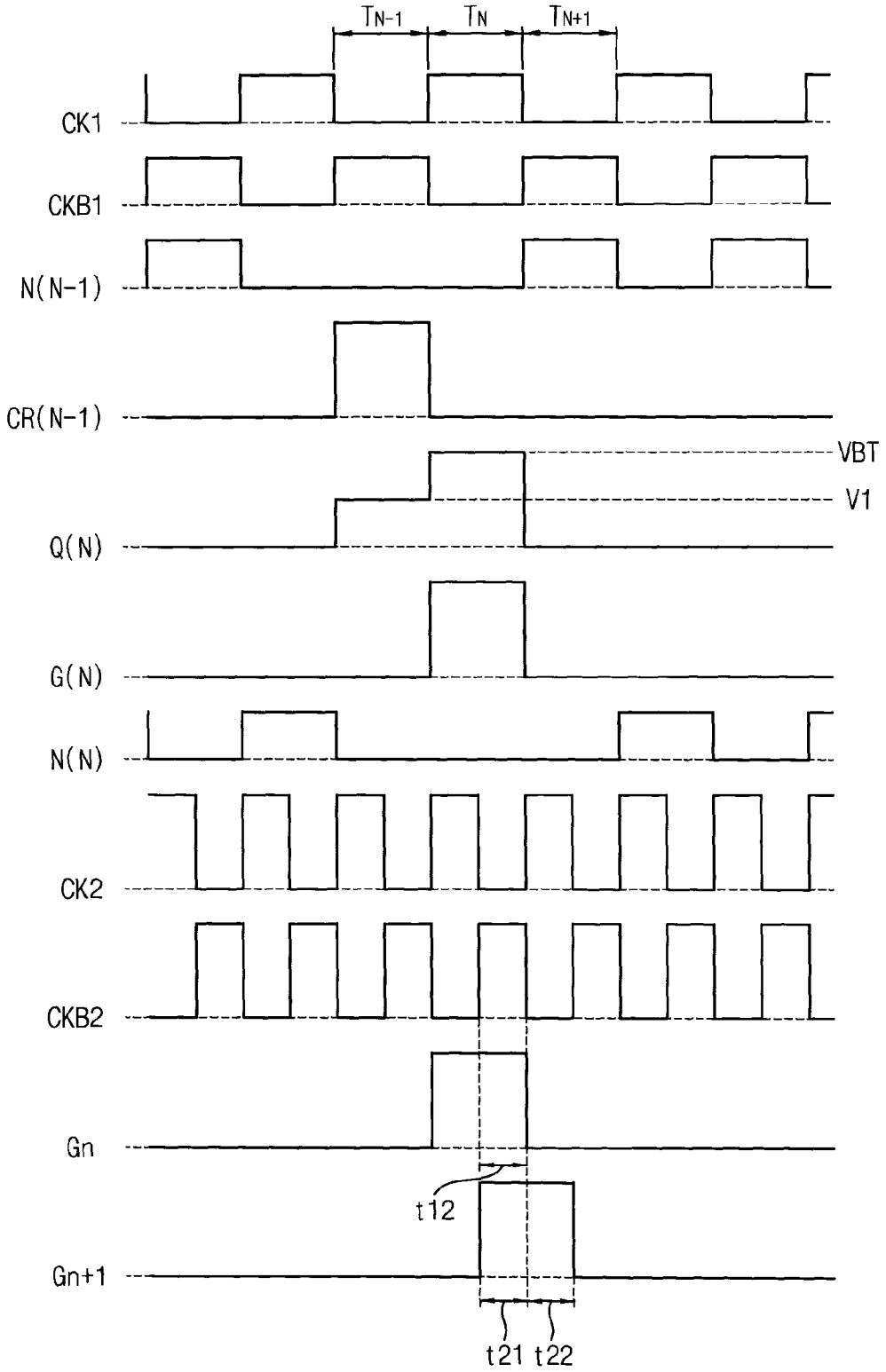
FIG. 4 is waveforms timing diagram showing exemplary signals of the stage of FIG. 3.

FIG. 3 is a circuit diagram illustrating internal details of a stage of FIG. 2. FIG. 4 is waveforms timing and levels diagram showing signals of a stage of FIG. 3.

Referring to FIGS. 3 and 4, the N-th stage SRCN includes a shared first circuit part 200A (shared by GT1 and Gt2) which is configured to help generate both gate signals in a shared manner. The N-th stage SRCN further includes a bifurcated second circuit part 200B configured to sequentially output at least two respective gate signals to a corresponding at least two gate lines.

The first circuit part 200A includes a control pull-down part 210, a pull-up part 220, a carry part 230, an inverting part 240, a first pull-down part 251, a second pull-down part 252, a carry stabilizing part 260, a first holding part 271, a second holding part 282 and a third holding part 238.

The control pull-down part 210 applies an (N−1)-th carry signal CRN-1 to a control node (a first node Q, at gate of transistor T1 within part 220) in response to the (N−1)-th carry signal CRN-1 of an (N−1)-th stage.

The control pull-down part 210 includes a fourth transistor T4. The fourth transistor T4 includes a control electrode (gate) and an input electrode (source) which are connected to the first input terminal IN1 receiving the (N−1)-th carry signal CRN-1 and an output electrode (drain) which is connected to the first node Q. The first node Q is also connected to a control electrode of the pull-up part 230.

For example, the fourth transistor T4 may be a Field Relaxation Transistor (FRT) which includes a floating metal disposed between the drain electrode and the source electrode. The shorting of the source and gate electrodes of T4 is understood to imply a diode-connection type operation thereof.

The pull-up part 220 applies the first clock signal CK1 which is a control clock signal of the N-th stage, to a second node O (the T1 to T3 connection node) in response to a signal applied to the first node Q. The second node O is an output node which outputs an N-th gate signal G N of the N-th stage (not to be confused with the clock controlled, lower case signals, Gn+1 and Gn).

The pull-up part 220 includes a first transistor T1. The first transistor T1 includes a control electrode which is connected to the first node Q, an input electrode which is connected to the first clock terminal CT1 and an output electrode which is connected to the second node O.

For example, the control electrode of the first transistor T1 may be a gate electrode. The input electrode of the first transistor T1 may be a source electrode. The output electrode of the first transistor T1 may be a drain electrode.

The carry part 230 outputs the N-th carry signal CRN using the first clock signal CK in response to a signal applied to the first node Q.

The carry part 230 includes a 15-th transistor T15. The 15-th transistor T15 includes a control electrode which is connected to the first node Q, an input electrode which is connected to the first clock terminal CT1 and an output electrode which is connected to an output electrode of the first output terminal OT1 outputting an N-th carry signal CRN.

For example, the control electrode of the 15-th transistor T15 may be a gate electrode. The input electrode of the 15-th transistor T15 may be a source electrode. The output electrode of the 15-th transistor T15 may be a drain electrode.

The inverting part 240 includes a 12-th transistor T12, a 7-th transistor T7, a 13-th transistor T13 and an 8-th transistor T8. The 12-th transistor T12 includes a control electrode and an input electrode which are connected to the first clock terminal CT1 and an output electrode which is connected to a control electrode of the 7-th transistor T7. The 7-th transistor T7 includes a control electrode which is connected to the output electrode of the 12-th transistor T12, an input electrode which is connected to the first clock terminal CT1 and an output electrode which is connected to a third node N (on the T7 to T8 connection line). The 13-th transistor 113 includes a control electrode which is connected to a fourth node C (on the T15 to T11 connection line) being connected to the first output terminal OT1, an input electrode which is connected to the output electrode of the 12-th transistor T12 and an output electrode which is connected to the second voltage terminal VT2 receiving the second OFF voltage VSS2. The 8-th transistor T8 includes a control electrode which is connected to the fourth node C, an input electrode which is connected to the third node N and an output electrode which is connected to the second voltage terminal VT2.

For example, the control electrodes of the 12-th, 7-th, 13-th, and 8-th transistors T12, T7, T13 and T8 may be a gate electrode. The input electrodes of the 12-th, 7-th, 13-th, and 8-th transistors T12, T7, T13 and T8 may be a source electrode. The output electrode of the 12-th, 7-th, 13-th, and 8-th transistors T12, T7, T13 and T8 may be a drain electrode.

For example, the 12-th transistor T12 may be the Field Relaxation Transistor (FRT) which includes a floating metal disposed between the drain electrode and the source electrode.

The first pull-down part 251 pulls-down a voltage of the first node Q into the second OFF voltage VSS2 in response to the (N+1)-th carry signal CRN+1 of the (N+1)-th stage.

The first pull-down part 251 may include a plurality of switching elements which is connected in series. For example, the first pull-down part 251 may include two transistors which are connected in series.

For example, the first pull-down part 251 includes a 9-th transistor T9 and a (9-1)-th transistor T9-1. The 9-th transistor T9 includes a control electrode which is connected to the third input terminal IN3 receiving the (N+1)-th carry signal, an input electrode which is connected to the first node Q and an output electrode which is connected to the input electrode of the (9-1)-th transistor. The (9-1)-th transistor T9-1 includes a control electrode which is connected to the third input terminal IN3, an output electrode which is connected to the 9-th transistor T9 and an output electrode which is connected to the second voltage terminal VT2.

For example, the control electrodes of the 9-th and (9-1)-th transistors T9 and T9-1 may be a gate electrode. The input electrodes of the 9-th and (9-1)-th transistors T9 and T9-1 may be a source electrode. The output electrode of the 9-th and (9-1)-th transistors T9 and T9-1 may be a drain electrode.

The first pull-down part 251 includes a plurality of transistors which is connected in series so that a voltage between the first node Q and the second voltage terminal VT2 may be divided by the 9-th and (9-1)-th transistors T9 and T9-1. Thus, a degradation of the 9-th transistor T9 may be prevented.

The second pull-down part 252 pulls-down a voltage applied to the second node O into the first OFF voltage VSS1 in response to the (N+1)-th carry signal CRN+1. Thus, the N-th gate signal GN applied to the second node O is pulled-down into the first OFF voltage VSS1.

The second pull-down part 252 includes the second transistor T2. The second transistor T2 includes a control electrode which is connected to the third input terminal IN3, an input electrode which is connected to the second node O and an output electrode which is connected to the first voltage terminal VT1.

For example, the control electrode of the second transistor T2 may be a gate electrode. The input electrode of the second transistor T2 may be a source electrode. The output electrode of the second transistor T2 may be a drain electrode.

The carry stabilizing part 260 includes a 17-th transistor T17. The 17-th transistor T17 includes a control electrode which is connected to the third input terminal IN3, an input electrode which is connected to the fourth node C and an output electrode which is connected to the second voltage terminal VT2.

For example, the control electrode of the 17-th transistor T17 may be a gate electrode. The input electrode of the 17-th transistor T17 may be a source electrode. The output electrode of the 17-th transistor T17 may be a drain electrode.

The first holding part 271 may include a plurality of switching elements which are connected in series.

For example, the first holding part 271 may include two transistors which are connected in series. For example, the first holding part 271 includes a 10-th transistor T10 and a (10-1)-th transistor T10-1. The 10-th transistor T10 includes a control electrode which is connected to the third node N, an input electrode which is connected to the first node Q and an output electrode which is connected to the input electrode of the (10-1)-th transistor. The (10-1)-th transistor T10-1 includes a control electrode which is connected to the third node N, an input electrode which is connected to the output electrode of the 10-th transistor T10 and an output electrode which is connected to the second voltage terminal VT2.

For example, the control electrodes of the 10-th and (10-1)-th transistors T10 and T10-1 may be a gate electrode. The input electrodes of the 10-th and (10-1)-th transistors T10 and T10-1 may be a source electrode. The output electrode of the 10-th and (10-1)-th transistors T10 and T10-1 may be a drain electrode.

The second holding part 272 includes a third transistor T3. The third transistor T3 includes a control electrode which is connected to the third node N, an input electrode which is connected to the gate output terminal and an output electrode which is connected to the first voltage terminal VT1.

For example, the control electrode of the third transistor T3 may be a gate electrode. The input electrode of the third transistor T3 may be a source electrode. The output electrode of the third transistor T3 may be a drain electrode.

The third holding part 273 includes an 11-th transistor T11. The 11-th transistor T11 includes a control electrode which is connected to the third node N, an input electrode which is connected to the fourth node C and an output electrode which is connected to the second voltage terminal VT2.

For example, the control electrode of the 11-th transistor T11 may be a gate electrode. The input electrode of the 11-th transistor T11 may be a source electrode. The output electrode of the 11-th transistor T11 may be a drain electrode.

According to the present exemplary embodiment, the previous carry signal does not limit to the (N−1)-th carry signal and may be the carry signal outputted from one of the previous stages. In addition, the next carry signal does not limit to the (N+1)-th carry signal and may be the carry signal outputted from one of the next stages.

While the first circuit part 200A is commonly shared for controlling the driving of plural gate lines, the second circuit part 200B is subdivided into subparts dedicated to driving respective ones of the plural gate lines that are driven by the corresponding stage SRCN. More specifically, the second circuit part 200B may include a first output part 281, a second output part 282, a first output holding part 291 and a second output holding part 292.

The first output part 281 outputs a clocked version of the N-th gate signal GN applied to the second node O as an n-th gate signal Gn in response to the second clock signal CK2 through the first gate output terminal GT1.

The first output part 281 includes a (1-1)-th transistor T1-1. The (1-1)-th transistor T1-1 includes a control electrode which is connected to the second clock terminal CT2 receiving the second clock signal CK2, an input electrode which is connected to the second node O and an output electrode which is connected to the first gate output terminal GT1.

The control electrode of the (1-1)-th transistor T1-1 may be a gate electrode. The input electrode of the (1-1)-th transistor T1-1 may be a source electrode. The output electrode of the (1-1)-th transistor T1-1 may be a drain electrode.

The second output part 282 outputs a clocked version of the N-th gate signal GN applied to the second node O as an (n+1)-th gate signal Gn+1 in response to a second inversion clock signal CKB2 through the second gate output terminal GT2.

The second output part 282 includes a (1-2)-th transistor T1-2. The (1-2)-th transistor T1-2 includes a control electrode which is connected to a third clock terminal CT3 receiving the second inversion clock signal CKB2, an input electrode which is connected to the second node O and an output electrode which is connected to the second gate output terminal GT2.

The control electrode of the (1-2)-th transistor T1-2 may be a gate electrode. The input electrode of the (1-2)-th transistor T1-2 may be a source electrode. The output electrode of the (1-2)-th transistor T1-2 may be a drain electrode.

The first output holding part 291 may be used to pull down the n-th gate signal Gn of the first gate output terminal GT1 to the first OFF voltage VSS1 in response to an (N−1)-th inverting signal NN-1 outputted from a third node N of the (N−1)-th stage.

The first output holding part 291 includes a (2-1)-th transistor T2-1. The (2-1)-th transistor T2-1 includes a control electrode which is connected to a second input terminal IN2 receiving the (N−1)-th inverting signal NN-1, an input electrode which is connected to the first gate output terminal GT1 and an output electrode which is connected to the first voltage terminal VT1.

The control electrode of the (2-1)-th transistor T2-1 may be a gate electrode. The input electrode of the (2-1)-th transistor T2-1 may be a source electrode. The output electrode of the (2-1)-th transistor T2-1 may be a drain electrode.

The second output holding part 292 may be used to pull down the (n+1)-th gate signal Gn+1 of the second gate output terminal GT2 to the first OFF voltage VSS1 in response to the N-th inverting signal NN of the third node N.

The second output holding part 292 includes a (2-2)-th transistor T2-2. The (2-2)-th transistor T2-2 includes a control electrode which is connected to the third node N, an input electrode which is connected to the second gate output terminal GT2 and an output electrode which is connected to the first voltage terminal VT1.

The control electrode of the (2-2)-th transistor T2-2 may be a gate electrode. The input electrode of the (2-2)-th transistor T2-2 may be a source electrode. The output electrode of the (2-2)-th transistor T2-2 may be a drain electrode.

Referring to FIGS. 3 and 4, a method of driving of the first circuit part 200A will be explained.

When a high voltage of the (N−1)-th carry signal CRN-1 is received, a first voltage V1 which corresponds to the high voltage of the (N−1)-th carry signal CRN-1 is applied to the first node Q.

In a state in which the first voltage V1 of the first node Q is applied to a control electrode of the pull-up part 220, when a high voltage of the first clock signal CK is received, the first node Q is boosted up to a boosted voltage VBT that is greater than the first voltage V1. Thus, the first node Q has the first voltage V1 during an (N−1)-th period T N−1, and has the boosted voltage VBT during an N-th period TN. This is shown in the timing waveform for Q(N) in FIG. 4.

During the N-th period T N in which the boosted voltage VBT is applied to the control electrode of the pull-up part 220, the pull-up part 220 outputs an N-th gate signal GN of a high voltage VDD to the second node O. This is shown in the timing waveform for G(N) in FIG. 4.

The carry part 230 outputs the N-th carry signal CRN synchronized with the first clock signal CK1 through the first output terminal OT1 in response to the high voltage of the first node Q.

The inverting part 240 applies an N-th inverting signal NN which has a phase identical to that of the first clock signal CK1 received from the first clock terminal CT1 to the third node N, during a remaining period of the frame period except the N-th period TN during which the N-th carry signal CRN has the high voltage.

However, in the (N−1)-th stage, the inverting part 240 applies an (N−1)-th inverting signal NN-1 which has a phase identical to that of the first inversion clock signal CKB1 received from the first clock terminal CT1 to the third node N, during a remaining period of the frame period except the (N−1)-th period TN-1 during which the (N−1)-th carry signal CRN-1 has the high voltage. This is shown in the timing waveform for N(N−1) in FIG. 4.

The 9-th and (9-1)-th transistors T9 and T9-1 of the first pull-down part 251 pull-down a voltage of the first node Q into the second OFF voltage VSS2 in response to the (N+1)-th carry signal CRN+1. The second transistor T2 of the second pull-down part 252 pulls-down a voltage of the second node O into the first OFF voltage VSS1 in response to the (N+1)-th carry signal CRN+1. In addition, the 17-th transistor T17 of the carry stabilizing part 260 pulls-down the N-th carry signal CRN of the fourth node C into the second OFF voltage VSS2.

In response to a high voltage of the N-th inverting signal NN applied to the third node N, the 10-th and (10-1)-th transistors T10 and T10-1 of the first holding part 271 maintain the voltage of the first node Q to the second OFF voltage VSS2. And, the 13-th transistor T13 of the second holding part 272 maintains the N-th gate signal G N of the second node O to the first OFF voltage VSS1. The 11-th transistor T11 of the third holding part 273 maintains the N-th carry signal CRN of the fourth node C to the second OFF voltage VSS2.

Hereinafter, a method of driving the second circuit part 200B will be explained.

The (1-1)-th transistor T1-1 of the first output part 281 outputs the N-th gate signal G N of the second node O to the first gate output part GT1 in response to a high voltage of the second clock signal CK2. Thus, the first gate output part GT1 provides the N-th gate line with the n-th gate signal Gn.

Then, the (1-2)-th transistor T1-2 of the second output part 282 outputs the clocked version of the N-th gate signal G N of the second node O to the second gate output part GT2 in response to a high voltage of the second inversion clock signal CKB2. Thus, the second gate output part GT2 provides the (n+1)-th gate line with the clocked (n+1)-th gate signal Gn+1. Therefore, an early period t21 of the (n+1)-th gate signal Gn+1 overlaps with a later period t12 of the n-th gate signal Gn. Although not shown in the figures, it is to be understood that, similarly; a later period t22 of the (n+1)-th gate signal Gn+1 overlaps with an early period of an (n+2)-th gate signal Gn+2.

However, the first output holding part 291 maintains the n-th gate signal Gn to the first OFF voltage VSS1 in response to the high voltage of the (N−1)-th inverting signal N N−1.

The second output holding part 292 maintains the (n+1)-th gate signal Gn+1 to the first OFF voltage VSS1 in response to the high voltage of the N-th inverting signal NN.

According to the present exemplary embodiment, the one, N-th stage SRCN therefore outputs plural gate signals, namely, the n-th and (n+1)-th gate signals Gn and Gn+1 and thus, rising periods of the n-th and (n+1)-th gate signals Gn and Gn+1 are in the N-th period TN corresponding to a high period of the N-th gate signal GN.

In other words, a single stage (SRCN) outputs at least two respective gate signals to respectively drive at least two gate lines so that the number of transistors (more specifically, the ones that perform the functions in the shared first circuit part 200A) in the gate driver circuit may be decreased and accordingly a size of the gate driver circuit may be decreased. Thus, a size of the peripheral area in the display panel may be decreased so that the display apparatus may have a narrower bezel than would be possible if each gate line had its own dedicated, single stage.

Figure 5:
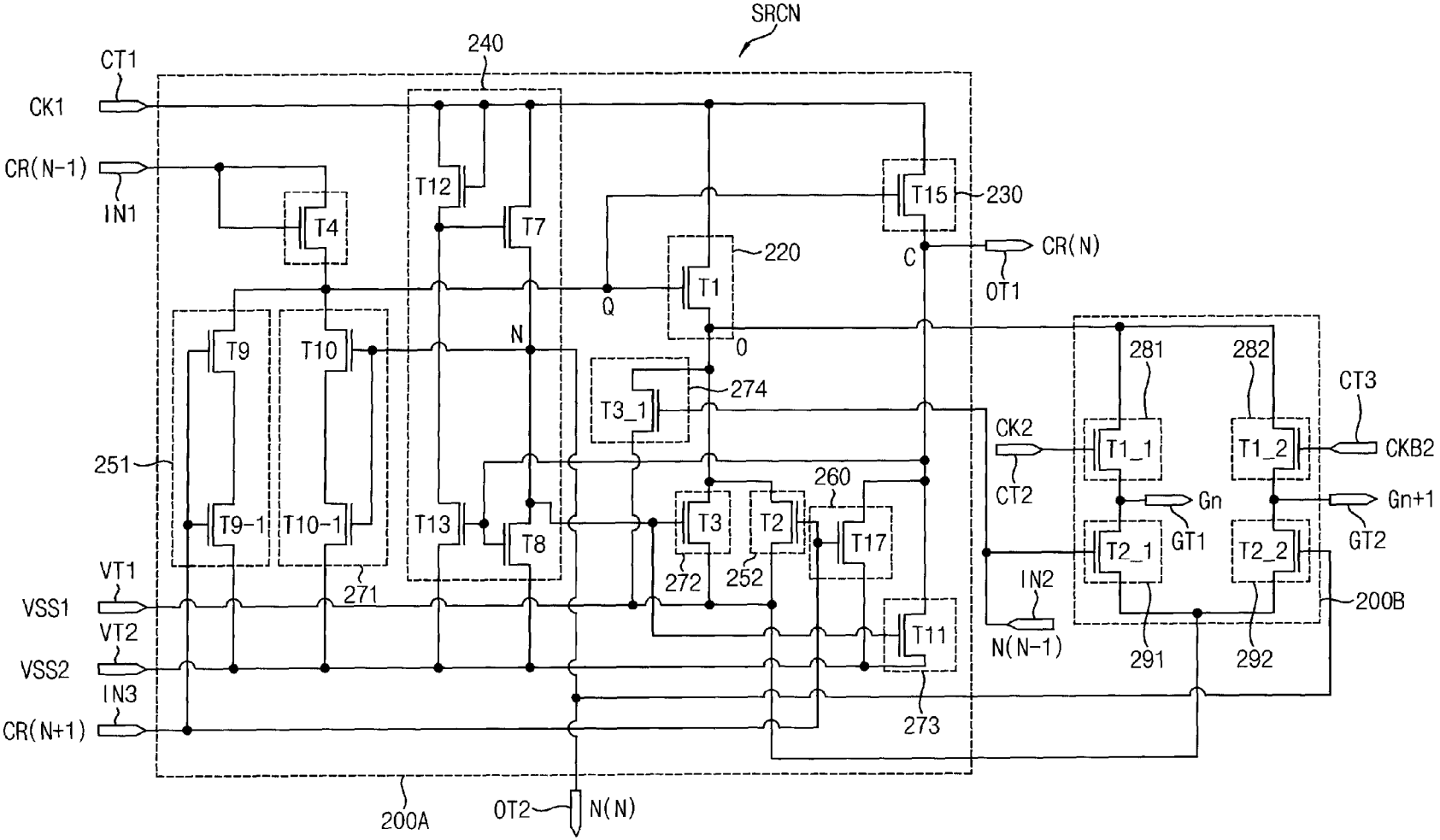
FIG. 5 is a circuit diagram illustrating a stage according to another exemplary embodiment.

FIG. 5 is a circuit diagram illustrating a stage according to another exemplary embodiment in accordance with the present disclosure of invention.

The display apparatus according to the present exemplary embodiment further includes a fourth holding part 274 (including transistor T3-1) which stabilizes the second node O in comparison with the display apparatus of the previous exemplary embodiment referring to FIGS. 1 to 4. Hereinafter, the same reference numerals are used to refer to the same or like parts as those described in the previous exemplary embodiments, and the same detailed explanations are not repeated unless necessary.

Referring to FIG. 5, the fourth holding part 274 maintains the voltage of the second node O to the first OFF voltage VSS1 in response to the high voltage OF the (N−1)-th inverting signal N−1 outputted from the third node N of the (N−1)-th stage.

More specifically, the fourth holding part 274 includes a (3-1)-th transistor T3-1. The (3-1)-th transistor T3-1 includes a control electrode which is connected to the second input terminal IN2 receiving the (N−1)-th inverting signal N−1, an input electrode which is connected to the second node O and an output electrode which is connected to the first voltage terminal VT1.

The control electrode of the (3-1)-th transistor T3-1 may be a gate electrode. The input electrode of the (3-1)-th transistor T3-1 may be a source electrode. The output electrode of the (3-1)-th transistor T3-1 may be a drain electrode.

The fourth holding part 274 maintains the voltage of the second node O to the first OFF voltage VSS1 in response to the (N−1)-th inverting signal N−1 during a remaining period of the frame period except for the N-th period TN.

In comparison with the previous exemplary embodiment, the present exemplary embodiment of FIG. 5 may stabilize the N-th gate signal G N of the second node O by the fourth holding part 274 and thus, the first OFF voltage VSS1 of the n-th and (n+1)-th gate signals Gn and Gn+1 may be better stabilized. Therefore, a reliability of the gate signal may be improved.

Figure 6:
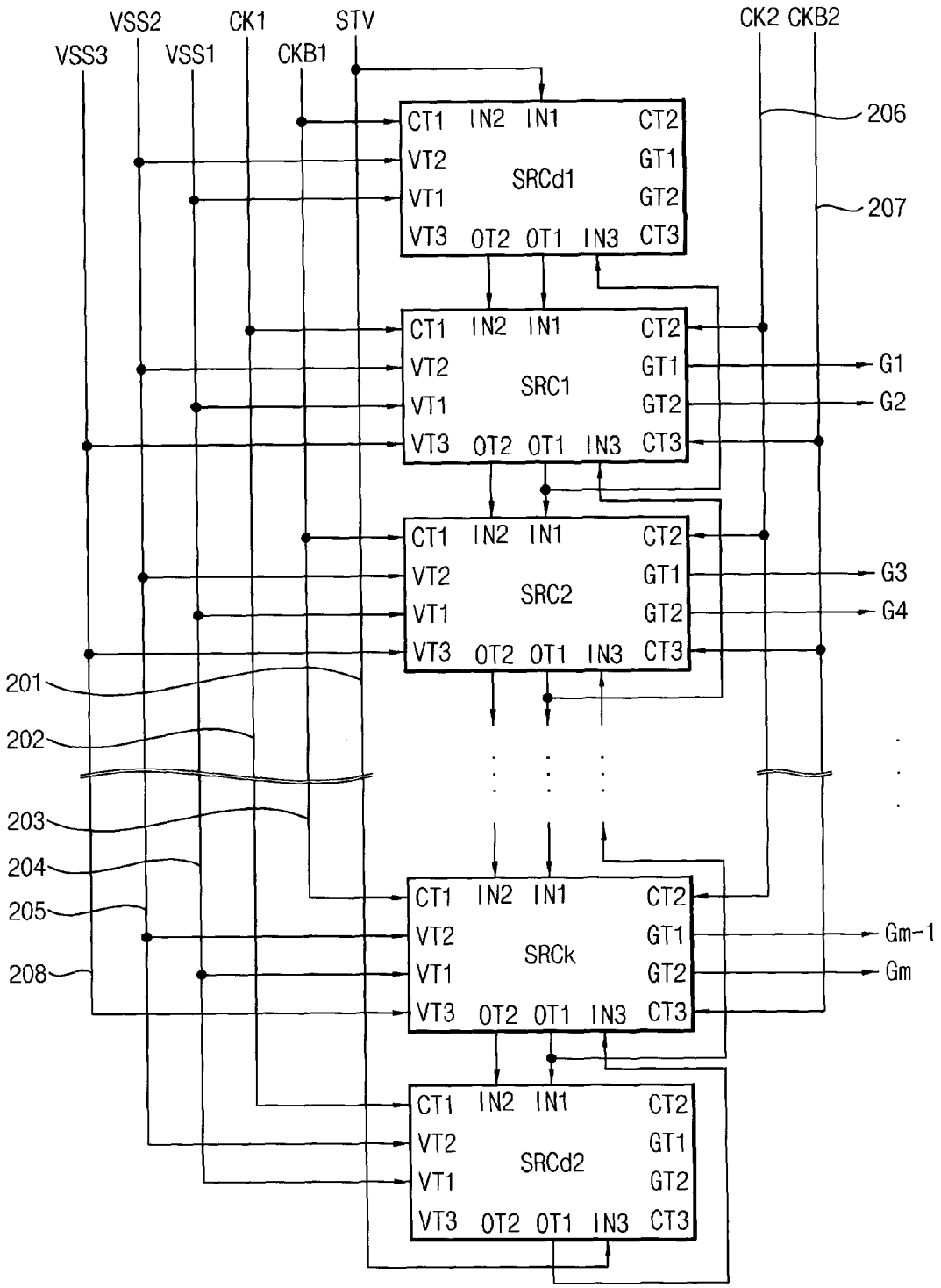
FIG. 6 is a block diagram illustrating a gate driver circuit according to yet another exemplary embodiment.
Figure 7:
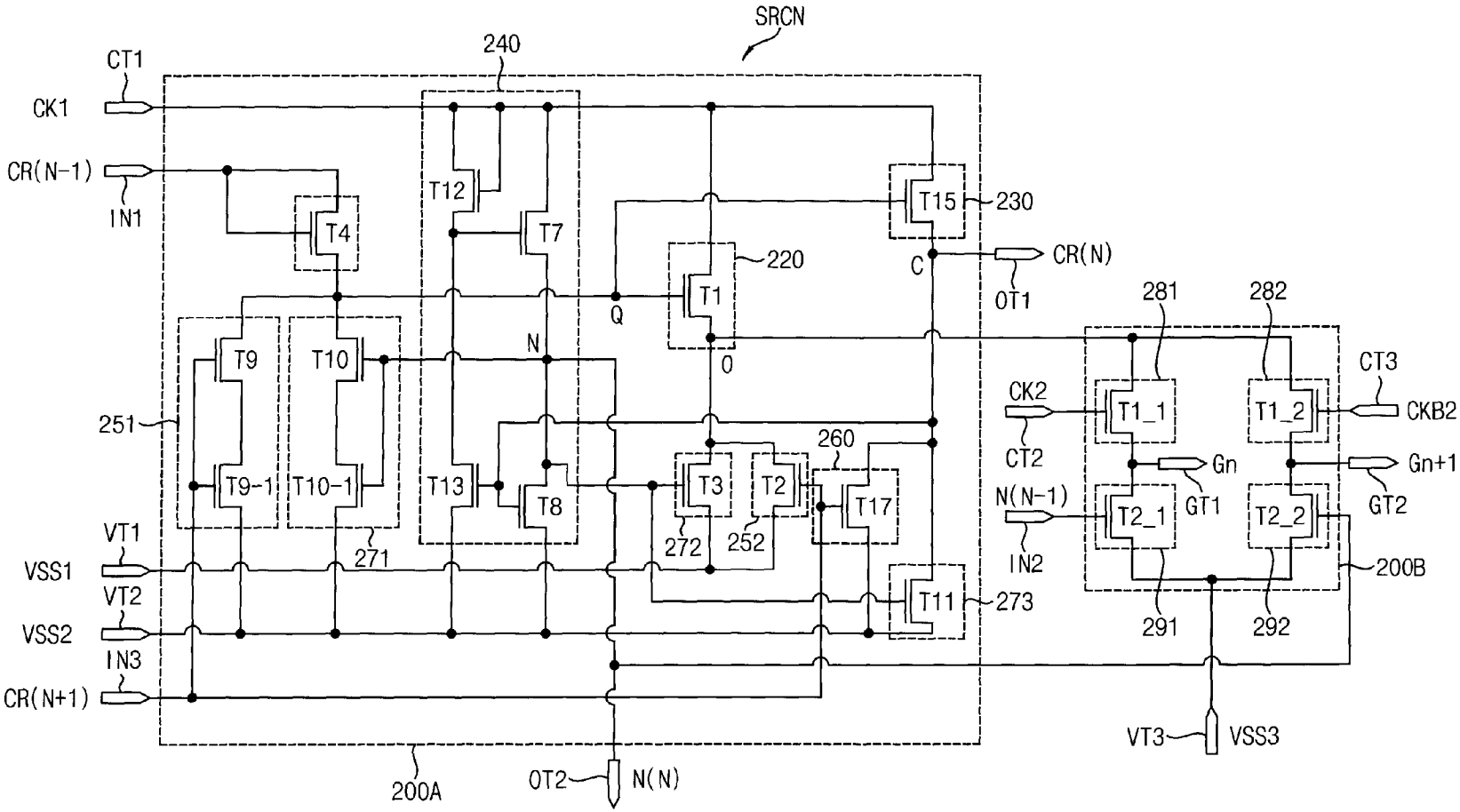
FIG. 7 is a circuit diagram illustrating a stage of FIG. 6.

FIG. 6 is a block diagram illustrating a gate driver circuit according to yet another exemplary embodiment. FIG. 7 is a circuit diagram illustrating an exemplary stage of FIG. 6.

The display apparatus according to the present exemplary embodiment further includes an eighth driving line 208 which transfers a third OFF voltage VSS3 in comparison with the display apparatus of the previous exemplary embodiment referring to FIGS. 1 to 4. Hereinafter, the same reference numerals are used to refer to the same or like parts as those described in the previous exemplary embodiments, and the same detailed explanations are not repeated unless necessary.

Referring to FIGS. 6 and 7, the gate driver circuit 200 may include a plurality of driving lines which respectively transfer a plurality of driving signals and a shift register which is connected to the plurality of driving lines.

The a plurality of driving lines includes first, second, third, fourth, fifth, sixth, seventh and eighth driving lines 201, 201, 203, 204, 205, 206, 207 and 208.

The eighth driving line 208 transfers the third OFF voltage VSS3. The third OFF voltage VSS3 is applied to a third voltage terminal VT3 of each stage.

The third OFF voltage VSS3 has a different level from that of the first OFF voltage VSS1 and that of the second OFF voltage VSS2. For example, the third OFF voltage VSS3 may be greater than the first OFF voltage VSS1 or less than the first OFF voltage VSS1.

Referring to FIG. 7, an N-th stage SRCN includes a first circuit part 200A which generates an N-th gate signal G N and a second circuit part 200B sequentially outputs n-th gate signal Gn and the (n+1)-th gate signals Gn+1 utilizing the N-th gate signal during an N-th period that is a high period of the N-th gate signal.

The first circuit part 200A is substantially the same as those of the previous exemplary embodiment shown in FIG. 3 and the same detailed explanations are not repeated unless necessary.

The second circuit part 200B includes a first output part 281, a second output part 282, a first output holding part 291 and a second output holding part 292.

The first output part 281 outputs a clocked version of the N-th gate signal GN applied to the second node O as an n-th gate signal Gn in response to the second clock signal CK2 through the first gate output terminal GT1.

The first output part 281 includes a (1-1)-th transistor T1-1. The (1-1)-th transistor T1-1 includes a control electrode which is connected to the second clock terminal CT2 receiving the second clock signal CK2, an input electrode which is connected to the second node O and an output electrode which is connected to the first gate output terminal GT1.

The control electrode of the (1-1)-th transistor T1-1 may be a gate electrode. The input electrode of the (1-1)-th transistor T1-1 may be a source electrode. The output electrode of the (1-1)-th transistor T1-1 may be a drain electrode.

The second output part 282 outputs the clocked version of the N-th gate signal GN applied to the second node O as an (n+1)-th gate signal Gn+1 in response to a second inversion clock signal CKB2 through the second gate output terminal GT2.

The second output part 282 includes a (1-2)-th transistor T1-2. The (1-2)-th transistor T1-2 includes a control electrode which is connected to a third clock terminal CT3 receiving the second inversion clock signal CKB2, an input electrode which is connected to the second node O and an output electrode which is connected to the second gate output terminal GT2.

The control electrode of the (1-2)-th transistor T1-2 may be a gate electrode. The input electrode of the (1-2)-th transistor T1-2 may be a source electrode. The output electrode of the (1-2)-th transistor T1-2 may be a drain electrode.

The first output holding part 291 maintains (pulls down) the n-th gate signal Gn of the first gate output terminal GT1 to the third OFF voltage VSS3 in response to an (N−1)-th inverting signal NN-1 outputted from a third node N of the (N−1)-th stage.

The first output holding part 291 includes a (2-1)-th transistor T2-1. The (2-1)-th transistor T2-1 includes a control electrode which is connected to a second input terminal IN2 receiving the (N−1)-th inverting signal NN-1, an input electrode which is connected to the first gate output terminal GT1 and an output electrode which is connected to the third voltage terminal VT3.

The control electrode of the (2-1)-th transistor T2-1 may be a gate electrode. The input electrode of the (2-1)-th transistor T2-1 may be a source electrode. The output electrode of the (2-1)-th transistor T2-1 may be a drain electrode.

The second output holding part 292 maintains the (n+1)-th gate signal Gn+1 of the second gate output terminal GT2 to the third OFF voltage VSS3 in response to the N-th inverting signal NN of the third node N.

The second output holding part 292 includes a (2-2)-th transistor T2-2. The (2-2)-th transistor T2-2 includes a control electrode which is connected to the third node N, an input electrode which is connected to the second gate output terminal GT2 and an output electrode which is connected to the third voltage terminal VT3.

The control electrode of the (2-2)-th transistor T2-2 may be a gate electrode. The input electrode of the (2-2)-th transistor T2-2 may be a source electrode. The output electrode of the (2-2)-th transistor T2-2 may be a drain electrode.

According to the present exemplary embodiment, the third OFF voltage VSS3 applied to the first and second output holding parts 291 and 292 may be preset based on a driving condition of the first and second output parts 281 and 282 unrelated to the first and second OFF voltages VSS1 and VSS2 which are preset based on a driving condition of the first and second nodes Q and O of the first circuit part 200A. Thus, a degradation of the first and second output holding parts 291 and 292 may be prevented.

For example, the third OFF voltage VSS3 may be preset to be less than the first OFF voltage VSS1 so that the (1-1)-th and (1-2)-th transistors T1-1 and T1-2 of the first and second output parts 281 and 282 may be prevented from being degraded.

In addition, the third OFF voltage VSS3 may be preset so as to be greater than the first OFF voltage VSS1 so that a falling timing of the n-th and (n+1)-th gate signals Gn and Gn+1 may be decreased. Additionally, the third OFF voltage VSS3 may be a time varying signal that is at different times, less than the first OFF voltage VSS1 and then greater than the first OFF voltage VSS1.

As described above, according to the present exemplary embodiment, a product specification of the display apparatus may be improved.

According to the exemplary embodiments of the present disclosure, a single stage outputs a respective at least two gate signals to respectively drive at least two gate lines so that the number of transistors in the gate driver circuit may be decreased and a size of the gate driver circuit may be decreased. Thus, a size of the peripheral area in the display panel may be decreased so that the display apparatus may have a narrower bezel.

The foregoing is illustrative of the present disclosure and is not to be construed as limiting thereof. Although a few exemplary embodiments have been described, those skilled in the art will readily appreciate from the foregoing that many modifications are possible in the exemplary embodiments without materially departing from the novel teachings and advantages of the present disclosure. Accordingly, all such modifications are intended to be included within the scope of the present teachings. In the claims, means-plus-function clauses are intended to cover the structures described herein as performing the recited function and not only structural equivalents but also functionally equivalent structures. Therefore, it is to be understood that the foregoing is illustrative of the present disclosure of invention and is not to be construed as limited to the specific exemplary embodiments disclosed.

What is claimed is:

1. A gate driver circuit comprising a shift register in which a plurality of stages is connected one after another to each other, an N-th stage ('N' is a natural number) comprising:

a control pull-down part configured to apply a carry signal outputted from at least one of previous stages of the N-th stage to a control node;

a pull-up part configured to output an N-th gate signal using a first clock signal in response to a node signal of the control node;

a carry part configured to output an N-th carry signal using the first clock signal in response to the node signal of the control node;

a first pull-down part configured to pull-down the node signal of the control node into a second OFF voltage in response to a carry signal outputted from at least one of next stages of the N-th stage next stage;

a second pull-down part configured to pull-down the N-th gate signal into a first OFF voltage in response to a carry signal outputted from at least one of the next stages of the N-th stage;

a first output part connected to an n-th gate line and configured to output an n-th gate signal using the N-th gate signal in response to a second clock signal having a period shorter than the first clock signal ('n' is a natural number); and a second output part connected to an (n+1)-th gate line and configured to output an (n+1)-th gate signal using the N-th gate signal in response to a second inversion clock signal having a phase opposite to the second clock signal.

2. The gate driver circuit of claim 1, wherein a high level of the second clock signal is more than that of the first clock signal.

3. The gate driver circuit of claim 1, wherein the first pull-down part comprises a plurality of transistor.

4. The gate driver circuit of claim 1, further comprising:

an inverting part configured to output an N-th inverting signal synchronized with the first clock signal during a remaining period of a frame period except for a period during which the N-th carry signal has a high level.

5. The gate driver circuit of claim 4, further comprising:

a first output holding part configured to maintain the n-th gate signal to the first OFF voltage in response to an inverting signal outputted from one of the previous stages; and a second output holding part configured to maintain the (n+1)-th gate signal to the first OFF voltage in response to the N-th inverting signal.

6. The gate driver circuit of claim 5, wherein the first output holding part is controlled by an (N−1)-th inverting signal outputted from an (N−1)-th stage.

7. The gate driver circuit of claim 4, further comprising:

a first holding part configured to maintain a signal of the control node to the second OFF voltage in response to the N-th inverting signal;

a second holding part configured to maintain the N-th gate signal to the first OFF voltage in response to the N-th inverting signal; and a third holding part configured to maintain the N-th carry signal to the second OFF voltage in response to the N-th inverting signal.

8. The gate driver circuit of claim 7, wherein the first holding part comprises a plurality of transistors which is connected each other.

9. The gate driver circuit of claim 4, further comprising:

a fourth holding part configured to maintain the N-th gate signal to the first OFF voltage in response to the (N−1)-th inverting signal outputted from an (N−1)-th stage.

10. The gate driver circuit of claim 4, further comprising:

a first output holding part configured to maintain the N-th gate signal to a third OFF voltage in response to an inverting signal outputted from one of the previous stages; and a second output holding part configured to maintain the (N+1)-th gate signal to the third OFF voltage in response to the N-th inverting signal.

11. The gate driver circuit of claim 10, wherein the third OFF voltage has a level more than that of the first OFF voltage.

12. The gate driver circuit of claim 10, wherein the third OFF voltage has a level less than that of the first OFF voltage.

13. A display apparatus comprising:

a display panel comprising a display area on which a plurality of gate lines, a plurality of data lines and a plurality of pixel transistors are formed and a peripheral area surrounding the display area;

a data driver circuit outputting data signals to the data lines; and a gate driver circuit comprising a shift register in which a plurality of stages is connected one after another to each other, each of the stages comprising a plurality of transistor, an N-th stage ('N' is a natural number) comprising:

a control pull-down part configured to apply a carry signal outputted from at least one of previous stages of the N-th stage to a control node;

a pull-up part configured to output an N-th gate signal using a first clock signal in response to a node signal of the control node;

a carry part configured to output an N-th carry signal using the first clock signal in response to the node signal of the control node;

a first pull-down part configured to pull-down the node signal of the control node into a second OFF voltage in response to a carry signal outputted from at least one of next stages of the N-th stage next stage;

a second pull-down part configured to pull-down the N-th gate signal into a first OFF voltage in response to a carry signal outputted from at least one of the next stages of the N-th stage;

a first output part connected to an n-th gate line and configured to output an n-th gate signal using the N-th gate signal in response to a second clock signal having a period shorter than the first clock signal ('n' is a natural number); and a second output part connected to an (n+1)-th gate line and configured to output an (n+1)-th gate signal using the N-th gate signal in response to a second inversion clock signal having a phase opposite to the second clock signal.

14. The display apparatus of claim 13, wherein a high level of the second clock signal is more than that of the first clock signal.

15. The display apparatus of claim 13, wherein the N-th stage further comprises:

an inverting part configured to output an N-th inverting signal synchronized with the first clock signal during a remaining period of a frame period except for a period during which the N-th carry signal has a high level.

16. The display apparatus of claim 15, wherein the N-th stage further comprises:

a first output holding part configured to maintain the n-th gate signal to the first OFF voltage in response to an inverting signal outputted from one of the previous stages; and a second output holding part configured to maintain the (n+1)-th gate signal to the first OFF voltage in response to the N-th inverting signal.

17. The display apparatus of claim 16, wherein the N-th stage further comprises:

a first holding part configured to maintain a signal of the control node to the second OFF voltage in response to the N-th inverting signal;

a second holding part configured to maintain the N-th gate signal to the first OFF voltage in response to the N-th inverting signal; and a third holding part configured to maintain the N-th carry signal to the second OFF voltage in response to the N-th inverting signal.

18. The display apparatus of claim 17, wherein the N-th stage further comprises:

a fourth holding part configured to maintain the N-th gate signal to the first OFF voltage in response to the (N−1)-th inverting signal outputted from an (N−1)-th stage.

19. The display apparatus of claim 15, wherein the N-th stage further comprises:

a first output holding part configured to maintain the N-th gate signal to a third OFF voltage in response to an inverting signal outputted from one of the previous stages; and a second output holding part configured to maintain the (N+1)-th gate signal to the third OFF voltage in response to the N-th inverting signal.

20. The display apparatus of claim 19, wherein the third OFF voltage has a level different from that of the first OFF voltage.

* * * * *